US012403374B2

(12) United States Patent
Holland

(10) Patent No.: US 12,403,374 B2
(45) Date of Patent: Sep. 2, 2025

(54) KETTLEBELL SWING HAT

(71) Applicant: Adam John Holland, Margate City, NJ (US)

(72) Inventor: Adam John Holland, Margate City, NJ (US)

( * ) Notice: Subject to any disclaimer, the term of this patent is extended or adjusted under 35 U.S.C. 154(b) by 34 days.

(21) Appl. No.: 18/108,233

(22) Filed: Feb. 10, 2023

(65) Prior Publication Data

US 2023/0271076 A1 Aug. 31, 2023

Related U.S. Application Data

(60) Provisional application No. 63/309,165, filed on Feb. 11, 2022.

(51) Int. Cl.
*A63B 71/06* (2006.01)
*A63B 22/00* (2006.01)

(52) U.S. Cl.
CPC ..... *A63B 71/06* (2013.01); *A63B 22/001* (2013.01); *A63B 2071/0602* (2013.01); *A63B 2071/0694* (2013.01); *A63B 2208/0204* (2013.01); *A63B 2214/00* (2020.08)

(58) Field of Classification Search
CPC ..... A63B 71/06; A63B 22/001; A63B 2214/00; A63B 2071/0602; A63B 2071/0694; A63B 2208/0204; A63B 21/065; A63B 2023/0411; A63B 69/0086; A63B 71/0686; A63B 2022/0035; A63B 21/0726; A63B 21/4003; A63B 2022/0043; A63B 2071/0655; A63B 2071/0666; A42B 1/006; Y10S 2/918
See application file for complete search history.

(56) References Cited

U.S. PATENT DOCUMENTS

| | | | | |
|---|---|---|---|---|
| 5,734,993 | A * | 4/1998 | D'Oca | A42B 7/00 2/244 |
| 10,335,662 | B2 * | 7/2019 | Vilhelmsen | A63B 69/0059 |
| 10,661,122 | B1 * | 5/2020 | Banks | A63B 33/00 |
| 2004/0009833 | A1 * | 1/2004 | Selevan | A63B 69/0086 473/576 |
| 2013/0012367 | A1 * | 1/2013 | Williams | A63B 23/03525 482/108 |
| 2018/0133537 | A1 * | 5/2018 | Montantes | H02J 7/32 |

FOREIGN PATENT DOCUMENTS

| | | | | |
|---|---|---|---|---|
| DE | 202006000584 U1 * | 4/2006 | | A63B 69/0086 |
| KR | 20100041356 * | 4/2010 | | A42B 1/046 |

* cited by examiner

*Primary Examiner* — Sundhara M Ganesan
*Assistant Examiner* — Jacqueline N L Loberiza
(74) *Attorney, Agent, or Firm* — Herbert Smith Freehills Kramer (US) LLP

(57) ABSTRACT

A kettlebell swing hat may be described herein. The kettlebell swing hat may comprise a beanie cap with two holes at the crown of the beanie cap, a soft round ball with two holes through the soft round ball; and a sting with a first end and a second end. The string secures the soft round ball to the beanie cap by knotting the first end and the second end together. The kettlebell swing hat may assist in correcting the timing of the kettlebell swing. It may give feedback on the proper way to squat/hinge during the swing, and showcase instant feedback on whether or not the individual is generating enough power into the ground to create a safe and effective swing. The kettlebell swing hat may assist in fixing the overall technique and pinpoint any flaws within the exercise.

18 Claims, 15 Drawing Sheets

KETTLEBELL SWING HAT

FIELD OF INVENTION

This application is in the field of kettlebells.

CONTINUATION

This application is a Non-Provisional of U.S. Provisional Application No. 63/309,165, filed Feb. 11, 2022, the contents of which are hereby incorporated by reference.

BACKGROUND

The kettlebell swing is arguably one of the most effective exercises in the world, yet it is also one of the most technical movements. It is a full body ballistic exercise where you stand with your feet slightly wider than shoulder width, hinge your hips backwards while also squatting slightly and reach out with extended arms to grab the handle of a kettlebell placed 1-2 feet in front of you. A kettlebell is a heavy round object with a handle. It can be made of steel or cast iron, but may also been made of rubber, plastic and leather. You hike the heavy object between your legs towards your buttocks, as if you are hiking an American Football between your legs. Then, using the muscles of your legs, you must drive your feet into the ground with force standing tall quickly, while simultaneously swinging the kettlebell to your chest height with extended relaxed arms. This is the top of the kettlebell swing and is considered as one repetition of the exercise.

Once the kettlebell is at the top of the swing "floating", it is up to you to properly time the "drop" (descent) of the kettlebell back down with control. One visual reference is to imagine your hips playing "chicken" with the kettlebell. The timing of this action is crucial to the safety of the exercise. Once the kettlebell is about 6-8 inches in front of your hips, that's when you simultaneously hike the kettlebell back between your legs with force while returning to the starting hinge/squat position (this is the bottom of the kettlebell swing) then in a split second you will, again, drive your feet into the ground with ample force, stand tall, and swing the kettlebell back up to chest height to generate another repetition of the exercise. In other words, you must correctly time when to hinge/squat the hips back and down as the kettlebell is descending in preparation for another rep. Then there must be enough force applied into the ground with your feet and legs to perform the next repetition safely.

As effective as the kettlebell swing is, it is very complex with a lot of moving parts. Which is why any tool or method that helps teach the kettlebell swing properly or shorten the learning curve of this exercise, is valuable.

As such, a need exists for aiding in correcting the timing of the kettlebell swing and overall technique with instant feedback. Additionally, there is a need for identifying whether or not there is enough force applied into the ground to generate a safe and effective kettlebell swing.

SUMMARY

A kettlebell swing hat may be described herein. The kettlebell swing hat may comprise a beanie cap with two holes at the crown of the beanie cap, a soft round ball with two holes through the soft round ball; and a sting with a first end and a second end. The string secures the soft round ball to the beanie cap by knotting the first end and the second end together.

The kettlebell swing hat may assist in correcting the timing of the kettlebell swing. It may give feedback on the proper way to squat/hinge during the swing, and showcase instant feedback on whether or not the individual is generating enough power into the ground to create a safe and effective swing. Overall the kettlebell swing hat may assist in fixing the overall technique and pinpoint any flaws within the exercise.

The kettlebell swing hat may be a simple and effective tool for providing immediate and effective results about a user's kettlebell swing. The kettlebell swing hat is merely placed on the user's head and the user may begin swinging the kettlebell.

The kettlebell swing hat may revolutionize how kettlebell coaches and fitness trainers teach the kettlebell swing to clients and other members within the fitness community.

DETAILED DESCRIPTION OF THE DRAWINGS

Figure 1:
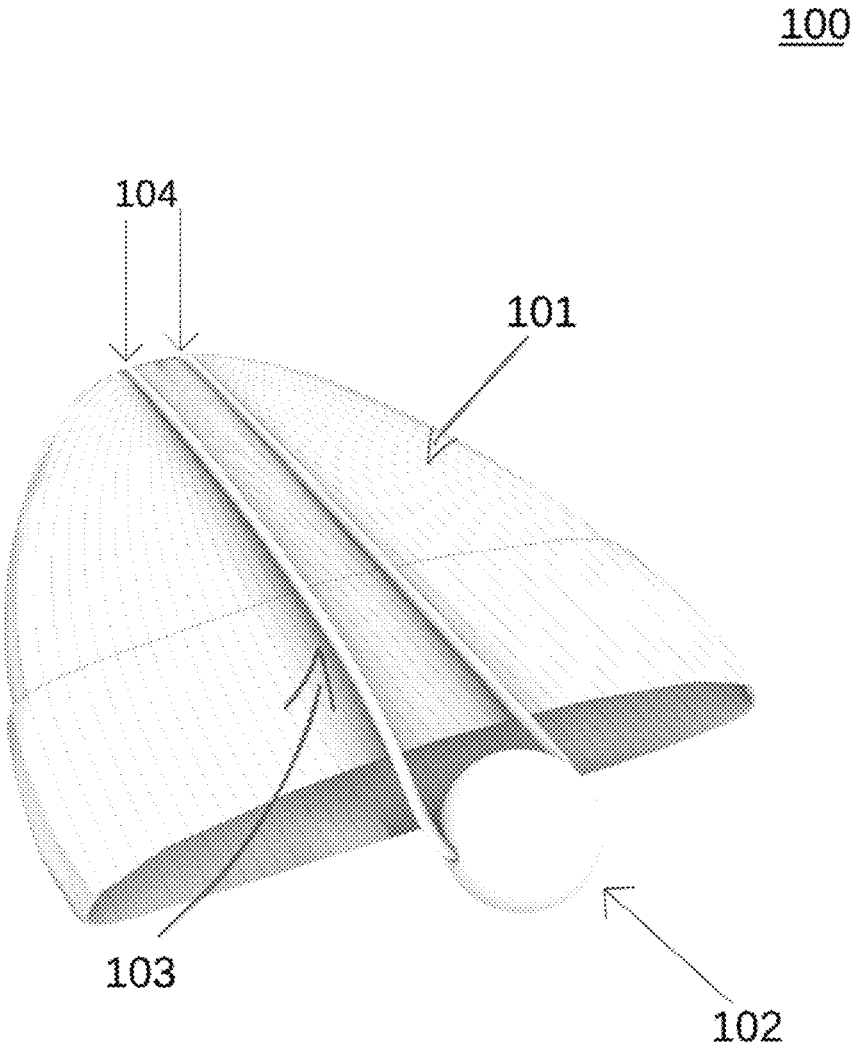
FIG. 1 is an example of the kettlebell swing hat.

This invention is described in the following description with reference to the Figures, in which like reference numbers represent the same or similar elements. While this invention is described in terms of modes for achieving this invention's objectives, it will be appreciated by those skilled in the art that variations may be accomplished in view of these teachings without deviating from the spirit or scope of the present invention. The embodiments and variations of the invention described herein, and/or shown in the drawings, are presented by way of example only and are not limiting as to the scope of the invention.

Unless otherwise specifically stated, individual aspects and components of the invention may be omitted or modified, or may have substituted one or more known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

A kettlebell swing hat may be described herein. The kettlebell swing hat may be comprised of a beanie cap, a string, and a soft round ball. The beanie cap may have two holes, approximately 2 mm wide, cut into the crown of the beanie cap. The holes may be approximately 1 cm from each other. The soft round ball may also have two small holes cut into the middle; the holes may go all the way through the soft round ball. One end of the string may then be placed in one hole and out the other hole of the soft round ball until the soft round ball sits at a center point of the string. The thickness of the string may secure the soft round ball in place. The two ends of the string may then be inserted into the beanie cap, approximately 1 inch on each end of the string. The ends of the string may be knotted together inside the beanie cap to keep it securely attached to the beanie cap.

The kettlebell swing hay may assist in correcting the timing of the kettlebell swing. It may also assist in adjusting the overall technique by giving instant feedback on whether or not an individual is properly hinging/squatting during the kettlebell swing. Additionally, the kettlebell swing hat may pinpoint whether or not there is enough force being applied into the ground to generate a safe, effective, and powerful kettlebell swing. The kettlebell swing hat may not only expose any flaws within the exercise, but may also assist in correcting the overall technique of the kettlebell swing.

The kettlebell swing is arguably one of the most effective exercises in the world, yet it is also one of the most technical movements. It is a full body ballistic exercise where a person stands, feet slightly wider than shoulder width, hinges their hips backwards while also squatting slightly, and reaches out with extended arms to grab the handle of a kettlebell placed 1-2 feet in front of the user. A kettlebell is a heavy round object with a handle. It can be made of steel or cast iron, but has also been made of rubber, plastic and leather. A user hikes the kettlebell between their legs towards their buttocks, as if hiking an American Football between one's legs. Then using the muscles of one's legs, the user drives their feet into the ground with force standing tall quickly, while simultaneously swinging the kettlebell to chest height with extended relaxed arms. This is the top of the kettlebell swing and is considered as one repetition of the exercise.

Once the kettlebell is at the top of the swing "floating", it is up to the user to properly time the "drop" (descent) of the kettlebell back down with control. One visual reference is to imagine the hips playing "chicken" with the kettlebell. The timing of this action is crucial to the safety of the exercise. Once the kettlebell is about 6-8 inches in front of one's hips, that's when the user simultaneously hikes the kettlebell back between their legs with force while returning to the starting hinge/squat position (this is the bottom of the kettlebell swing) then in a split second, again, drive their feet into the ground with ample force, stand tall, and swing the kettlebell back up to chest height to generate another repetition of the exercise. In other words, correct timing to hinge/squat the hips back and down as the kettlebell is descending in preparation for another rep. There must be enough force applied into the ground with feet and legs to perform the next repetition safely.

As effective as the kettlebell swing is, it is clearly complex with a lot of moving parts. Any tool or method that may help teach the kettlebell swing properly or shorten the learning curve of this exercise is valuable.

The kettlebell swing hat may be comprised of a beanie type hat with a soft round ball, attached approximately 8-12 inches above the crown of the user's head with a string. The kettlebell swing hat may be placed on the head user's head prior to beginning a kettlebell workout. The user may then follow the steps of a kettlebell workout, as described herein to start performing the kettlebell swing. When performing the kettlebell swing correctly the soft round ball of the kettlebell swing hat, attached to the string and hat, may swing up in an arching fashion, over the crown of one's head, and gently tap the back of the head at the top of the swing. Then as the user lowers the kettlebell, descending back down, the soft round ball may then reverse directions, swinging over the crown of one's head, and gently tapping just above the forehead at the exact timing of the bottom of the swing.

One objective of the kettlebell swing hat may be to correct the timing of the descent of the kettlebell swing or give you instant feedback on whether or not the timing is correct. In other words, when performing the swing correctly the soft round ball attached to the string of the kettlebell swing hat will not flail all over the place erratically hitting different parts of the head. Instead the soft round ball will flow directly over the crown of the head in a quick and smooth motion coming in contact with the top of the forehead at the exact time you are supposed to be at the bottom of the kettlebell swing.

The kettlebell swing hat may also give instant feedback on whether or not an individual is performing the hinge/squat correctly during the swing. In other words, if the user is hinging their hips back too little/too much or there isn't the correct balance between a hinge and squat during the swing, then the soft round ball may not hit the correct target points of the head at the correct time (For example, the back of the head at the top of the swing and just above the forehead at the bottom of the swing).

Additionally, the kettlebell swing hat may indicate whether or not there is enough force being applied into the ground to create a strong, powerful, and effective kettlebell swing. One very common incorrect version of the exercise is when individuals try to use their arms to lift the kettlebell during the ascent of the kettlebell swing, which may place a tremendous amount of stress on the shoulders. One reason for this may be because they are not placing enough force into the ground at the start of the upward trajectory of the exercise. For example, if a user is incorrectly swinging as described, and is wearing the kettlebell swing hat, the soft round ball attached to the kettlebell swing hat may not have the correct path or speed needed to hit the target points of the head at the correct timing of the swing. For example, the target points may be the back of the head at the top of the swing and just above the forehead at the bottom of the swing.

Overall, when performing kettlebell swings with the kettlebell swing hat on, the user not only may receive instant feedback on when the user is performing powerful, strong, and effective swings, but the user may also be given the proper feedback on when you are performing soft, weak, and inefficient swings, based on the path of the soft round ball and where it is hitting on the head of the individual. One tip to ensure the kettlebell swing hat is best utilized may be for the user performing the exercise to video tape themselves swinging the kettlebell with the kettlebell swing hat on. This way the user can also get a visual of where they may need improvements based off of the path and points of where the soft round ball is hitting on their head.

The kettlebell swing hat is a self-correcting device that may provide the necessary feedback to find out whether or not you are performing the exercise safely and correctly. The kettlebell swing hat is an improvement on current coaching tactics as it is a self-correcting device that requires no other assistance. The kettlebell swing hat may revolutionize how coaches and trainers are able to teach the kettlebell swing by providing instant and effective feedback.

FIG. 1 is an example of the kettlebell swing hat. The kettlebell swing hat 100 includes a beanie cap 101, a soft round ball 102, and a string 103. The string 103 may have a first and second end. The beanie cap 101 may have two small holes 104 at the top of the hat for attaching the string 103, creating a knot with the two ends of the string inside the beanie cap 101. The string 103 may be approximately 12-24 inches in length. The string may be made nylon, synthetic fibers, such as nylon, textured polyester, spun polyester or polypropylene, or the like. The soft round ball 103 may be attached to at the center part of the string 103. The soft round ball 103 may be made of cotton, sponge, orlon fiber, or any other soft material.

The beanie cap 101 may have two holes 104, approximately 2 mm wide, cut into the crown of the beanie cap 101. The holes 104 may be approximately 1 cm from each other. The soft round ball 102 may also have two small holes cut into the middle; the holes may go all the way through the soft round ball 102. One end of the string 103 may then be placed in one hole and out the other hole of the soft round ball until the soft round ball sits at a center point of the string. The thickness of the string may secure the soft round ball in place. The two ends of the string may then be inserted into the beanie cap 101, approximately 1 inch on each end of the string. Each end of the string may be inserted to each of the holes 104 created at the crown of the beanie cap 101. The ends of the string may be knotted together inside the beanie cap to keep it securely attached to the beanie cap 101.

The Kettlebell Swing Hat is first placed on a user's head, then the user stands with feet slightly wider than shoulder width. The user may then hinge their hips backwards while also squatting slightly. Then, with extended arms, the user may reach out and grab the handle of a kettlebell that sits approximately 1-2 feet in front of the user. The kettlebell is then hiked between the user's legs towards their buttocks, as if hiking an American Football between the legs. Then using their leg muscles, the user drives their feet into the ground with force standing tall quickly, while simultaneously swinging the kettlebell to chest height with extended relaxed arms (picture standing tall, eyes forward, with straight arms). This position is the top of the kettlebell swing and is considered as one repetition of the exercise. At this point of the exercise the soft round ball of the kettlebell swing hat may gently tap the back of the head, when performed correctly. This tap of the ball on the back of the user's head may provide the necessary feedback on whether or not the kettlebell swing is performed correctly.

Figure 2:
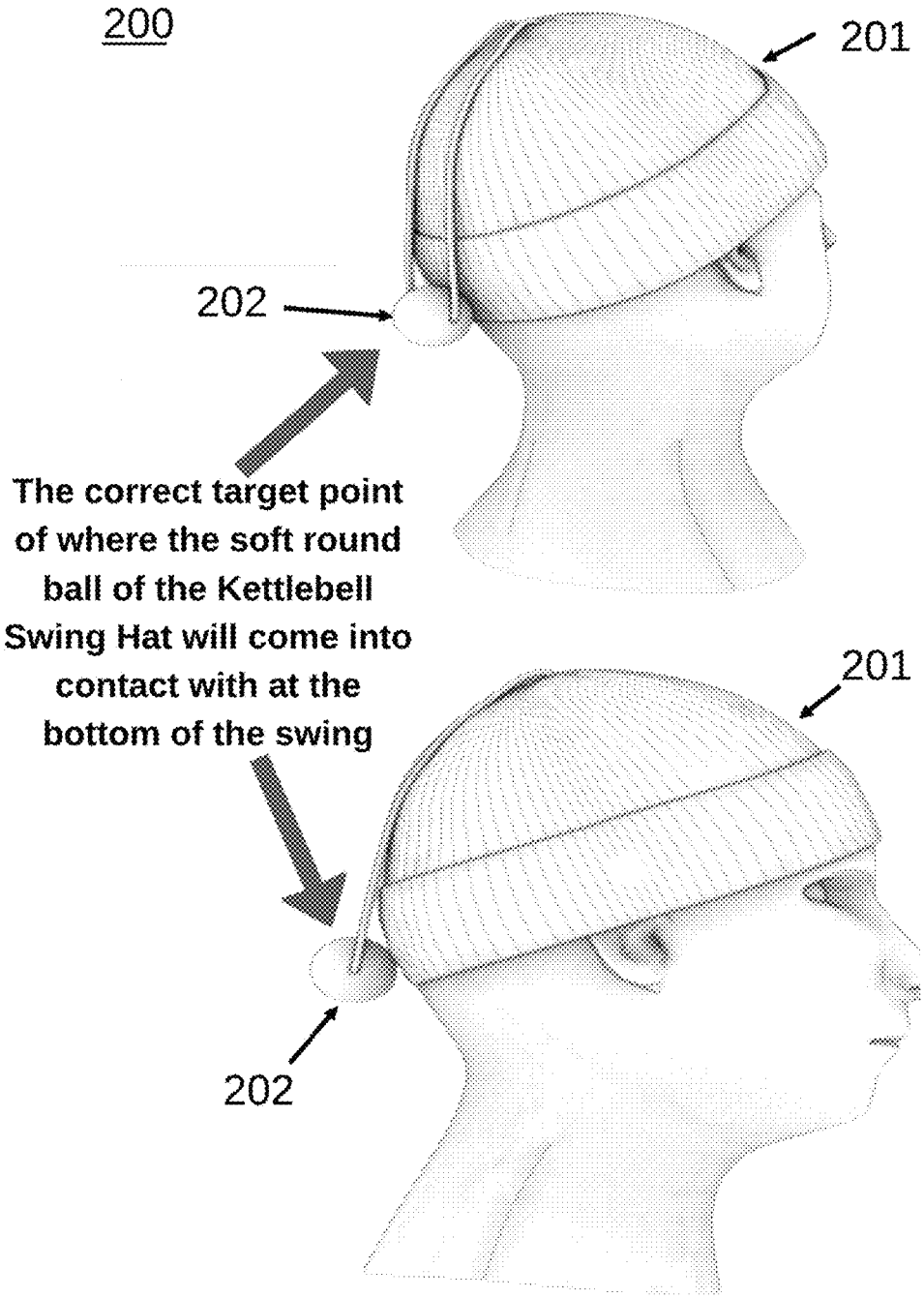
FIG. 2 is an example of the kettlebell swing hat on a user's head with the ball at the back of the head.

FIG. 2 is an example of the kettlebell swing hat on a user's head with the ball at the back of the head. When the kettlebell is hiked between the user's legs towards their buttocks and drives their feet into the ground with force standing tall quickly, while simultaneously swinging the kettlebell to chest height with extended relaxed arms, the soft round ball of the kettlebell swing hat may gently tap the back of the head, when performed correctly. As illustrated in FIG. 2, when the kettlebell swing hat 200 is on a user's head, the soft round ball 202 attached to the beanie cap 201 may tap center of the back of the head. This tap of the soft round ball 202 on the back of the user's head indicates that kettlebell swing was performed correctly.

Once the kettlebell is at the top of the swing "floating", the user must properly time the "drop" (the descent) of the kettlebell back down with control. One visual reference is to imagine the user's hips playing "chicken" with the kettlebell. The timing of this action is crucial to the safety of the lower back during the kettlebell swing. Once the kettlebell is about 6-8 inches in front of the user's hips, that's when they simultaneously hike the kettlebell back between their legs with force while returning to the starting hinge/squat position. This position is the bottom of the kettlebell swing. Once at the bottom of the swing, the soft round ball of the kettlebell swing hat may gently tap the top of the forehead. This will give the necessary feedback to indicate whether or not the kettlebell swing is performed correctly. After briefly being at the bottom of the swing, in a split second the user may then, again, drive their feet into the ground with ample force, stand tall, and swing the kettlebell back up to chest height to generate another repetition of the exercise.

Figure 3:
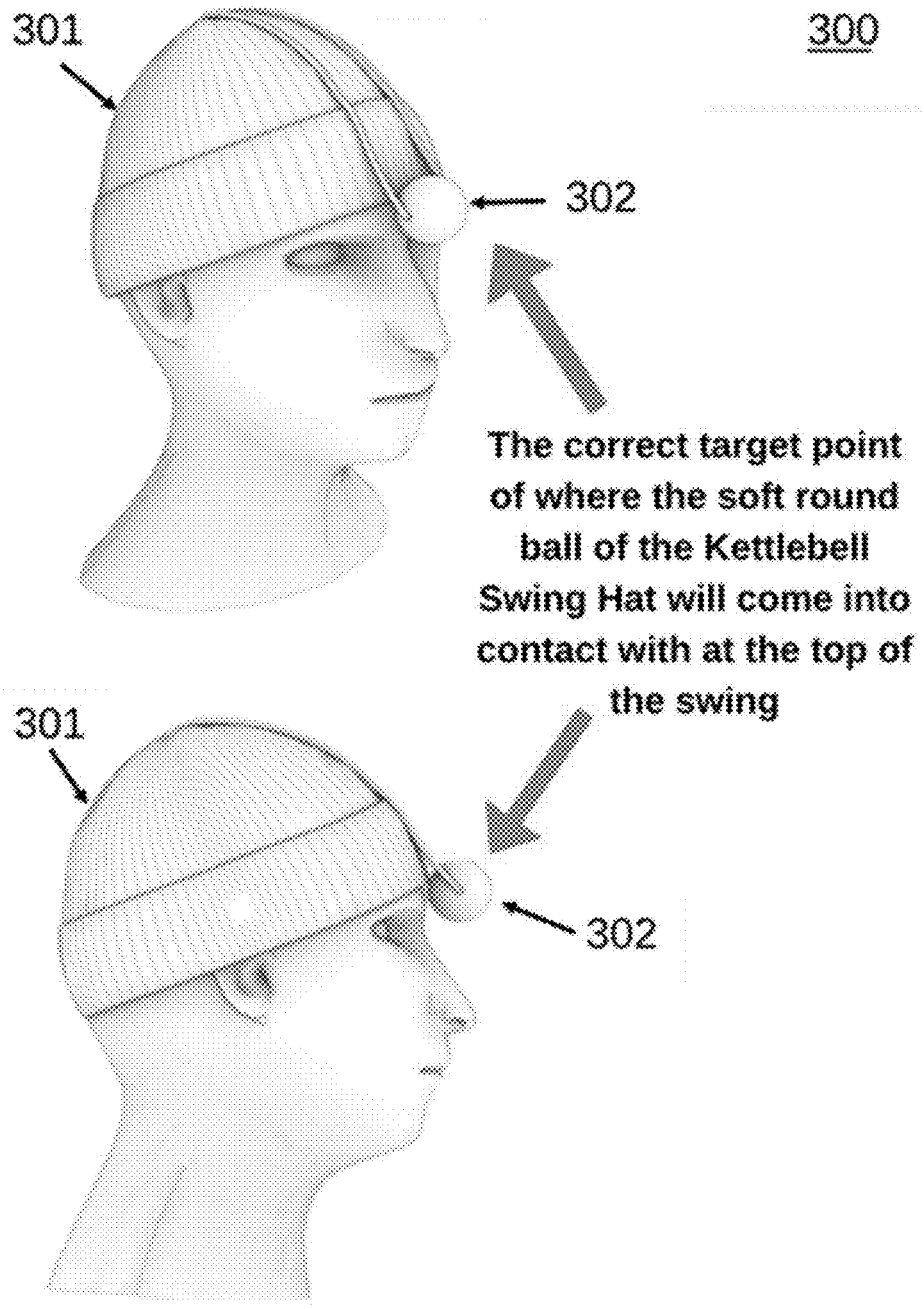
FIG. 3 is an example of the kettlebell swing hat on a user's head with the ball at the front of the head.

FIG. 3 is an example of the kettlebell swing hat on a user's head with the ball at the front of the head. The user must now properly time the "drop" (the descent) of the kettlebell back down with control. Once the kettlebell is about 6-8 inches in front of the user's hips, they simultaneously hike the kettlebell back between their legs with force while returning to the starting hinge/squat position. As illustrated in FIG. 3, when the kettlebell swing hat 300 is on a user's head, the soft round ball 302 attached to the beanie cap 301 may tap center of the back of the forehead. This tap of the soft round ball 302 on the forehead of the user's head indicates that kettlebell swing was performed correctly.

In other words, the user must correctly time when to hinge/squat the hips back and down as the kettlebell is descending in preparation for another rep. Then there must be enough force applied into the ground with the feet and legs of the individual to perform the next repetition safely. At both the bottom and top of the swing, the soft round ball will give the necessary feedback to the user on whether or not they are performing the exercise correctly or not.

One very common incorrect version of the kettlebell swing is when individuals try to use their arms to lift the kettlebell during the ascent of the kettlebell swing. This may place a tremendous amount of stress on the shoulders. One of the main reasons for this is because the users may not be placing enough force into the ground at the start of the upward trajectory of the exercise. If the user is incorrectly swinging like this with the kettlebell swing hat on, then the soft round ball attached to the hat will not have the correct path or speed needed to hit the target points of the head at the correct timing of the swing. For example, the correct timing and target points may be the back of the head at the top of the swing and just above the forehead at the bottom of the swing.

Overall, when kettlebell swings are performed with the kettlebell swing hat on, the user may not only receive instant feedback on when they are performing powerful, strong, and effective swings, but they may also be provided feedback on when they are performing soft, weak, and inefficient swings. This information may be based on the path of the soft round ball and where it is hitting on the head of the individual. One tip to ensure the kettlebell swing hat is best utilized may be for the user performing the exercise to video tape themselves swinging the kettlebell with the kettlebell swing hat on in a few different angles. This way the user may also get a visual of where they may need improvements based off of the path and points of where the soft round ball is hitting on their head.

The kettlebell swing hat may will assist in correcting the timing of the kettlebell swing exercise. It may also assist in fixing the overall technique by giving instant feedback on whether or not an individual is properly hinging/squatting during the kettlebell swing. Finally, it may pinpoint whether or not there is enough force being applied into the ground to generate a safe, effective, and powerful kettlebell swing.

Additionally, the kettlebell swing hat may be used simply as a beanie cap to keep the user warm.

FIGS. 4-15 may now demonstrate the placement of the soft round ball during both a good kettlebell swing and a bad kettlebell swing. FIGS. 4-11 illustrate a user in a good starting and finish position of the kettlebell swing exercise.

Figure 4:
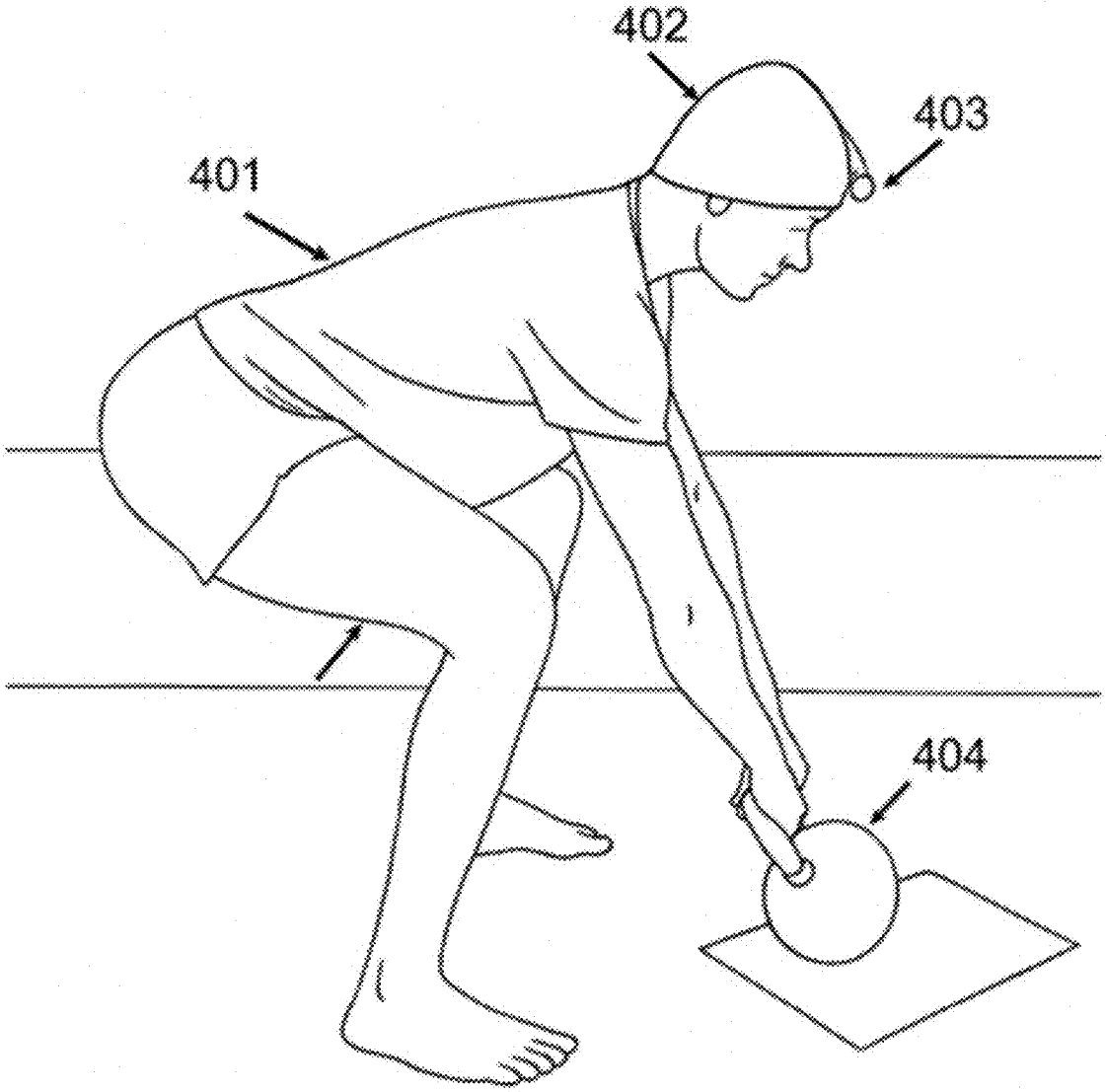
FIG. 4 is a first example of a good kettlebell swing with the kettlebell on the ground.

FIG. 4 is a first example of a good kettlebell swing with the kettlebell on the ground. The user 401, with the kettlebell swing hat 402 placed on their head, is positioned approximately 1 foot from a kettlebell 404 with their knees below their hips and hips slightly below their shoulders creating an angle similar to a greater than symbol (>). The user is correctly tilting the kettlebell 404 towards themselves with extended arms and eyes slightly up on the horizon. The soft round ball 403 may be resting slightly above their forehead. This is a suggested starting position of the soft round ball 403 of the kettlebell swing hat 402 to get the most out of every single rep of the exercise. The reason one may have the soft round ball 403 start elsewhere on the head may be because after a few correct, powerful, and efficient reps of the kettlebell swing the soft round ball 403 may redirect itself accurately flowing directly up and over the head coming in contact at the correct target points of the head, slightly above the forehead at the bottom of the swing and behind the head at the top of the swing.

Figure 5:
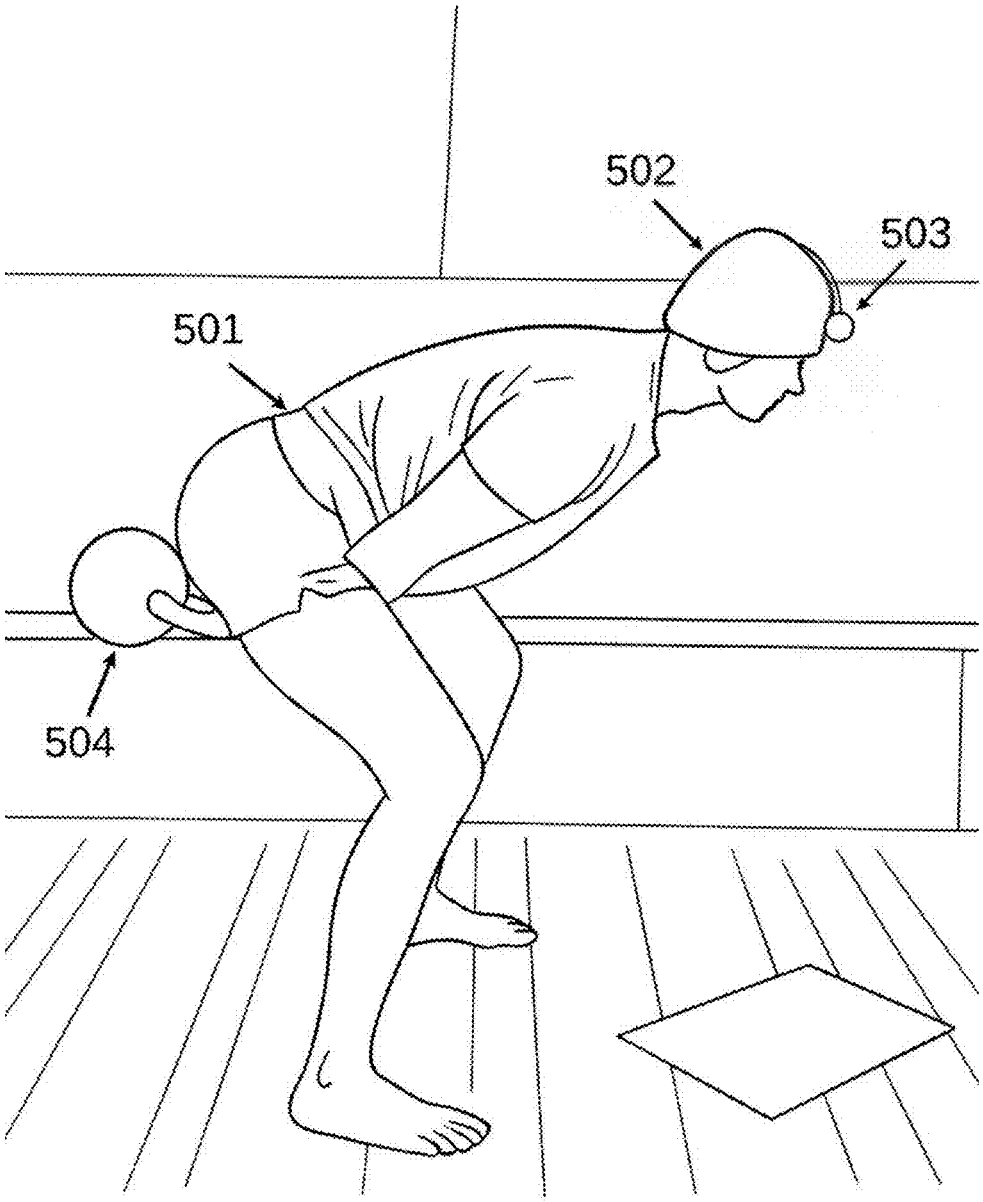
FIG. 5 is a second example of a good kettlebell swing with the kettlebell at the bottom of the swing.

FIG. 5 is a second example of a good kettlebell swing with the kettlebell at the bottom of the swing. As illustrated in FIG. 5, the user 501, with the kettlebell swing hat 502 placed on their head, is performing a good safe and effective bottom position of the kettlebell swing. This bottom position of the swing may also be referred to as the first initial "hike" of the kettlebell 504, also known as the first rep of the kettlebell swing. The user may have the proper balance between hinging the hips back and squatting the hips down with eyes up slightly up on the horizon. This bottom position of the swing is a very good representation of what is needed in order to perform a safe, strong, powerful, and effective kettlebell swing. The soft round ball 503 of the kettlebell swing hat 502 may be tapping just above the forehead at the bottom of the swing. Seeing or feeling the soft round ball 503 gently tap just above the forehead at the bottom of the kettlebell swing will give instant feedback that the bottom part of the kettlebell swing is correct.

Figure 6:
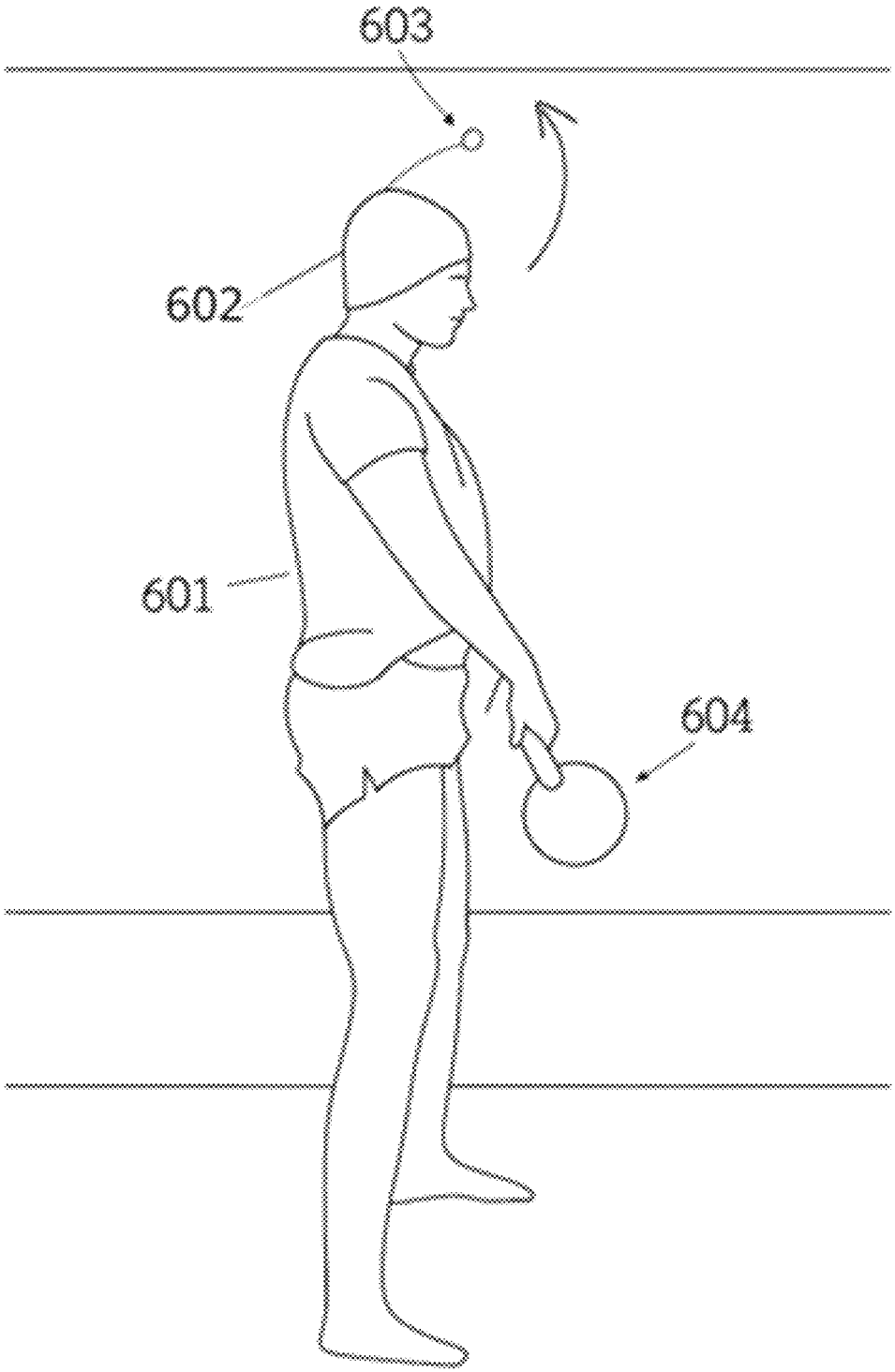
FIG. 6 is another example of a good kettlebell swing with the kettlebell in the ascent.

FIG. 6 is another example of a good kettlebell swing with the kettlebell in the ascent. As illustrated in FIG. 6, there may be an ample amount of force driven through the feet and legs into the ground as the user 601, wearing the kettlebell swing hat 602, is standing tall with intention while ascending the kettlebell 604 up from the bottom part of the swing to the top part of the swing. The soft round ball 603 of the kettlebell swing hat 602 may flow directly over the head in a round fashion preparing to come into contact with the correct target point at the back of the head at the top of the kettlebell swing. When seeing the soft round ball 603 and extended string flow over the head in an arc, it may indicate that the user is in the middle of performing a safe, powerful and effective kettlebell swing.

Figure 7:
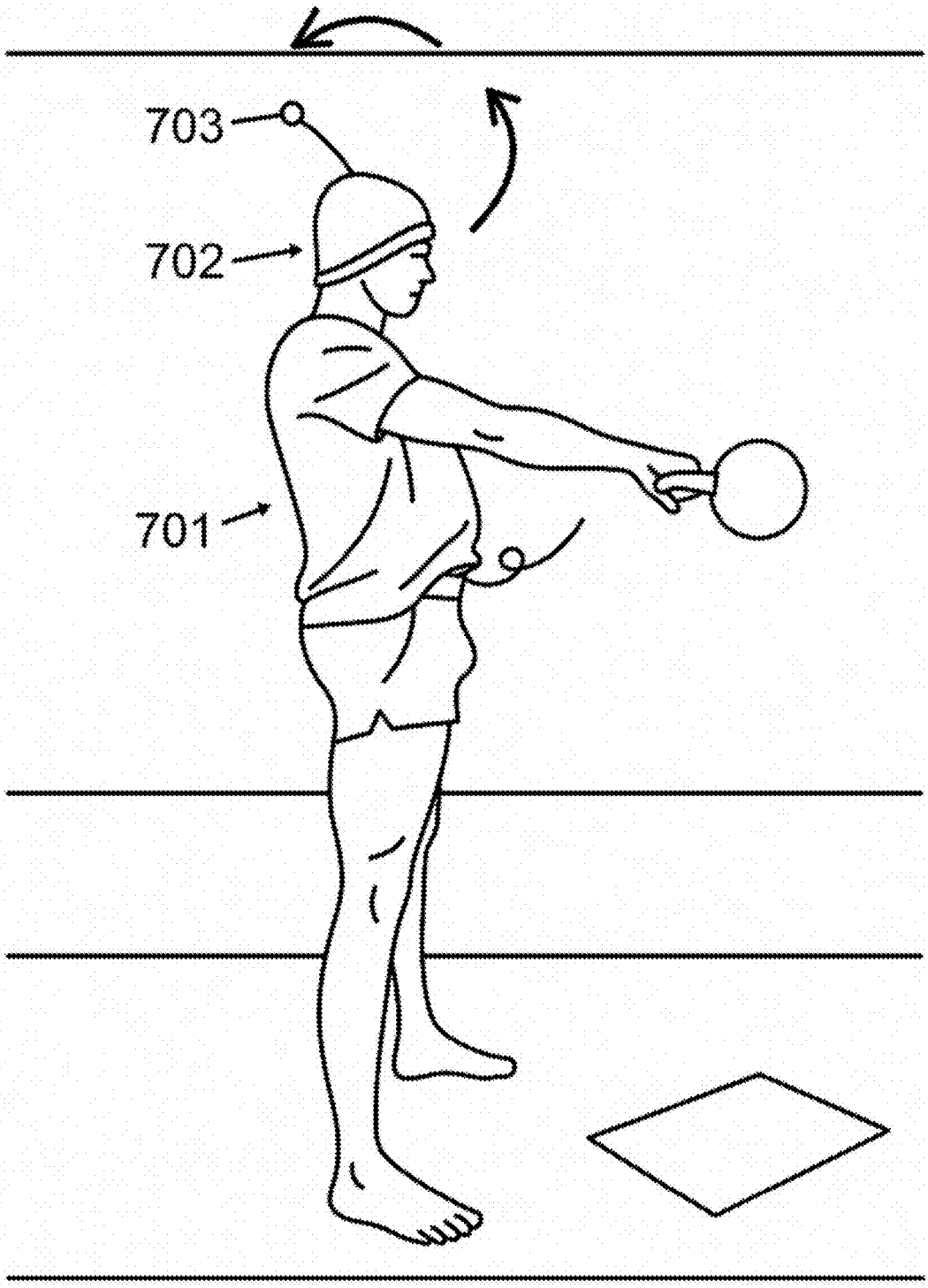
FIG. 7 is another example of a good kettlebell swing with the kettlebell in the ascent.

FIG. 7 is another example of a good kettlebell swing with the kettlebell in the ascent. As illustrated in FIG. 7, the user 701, wearing the kettlebell swing hat 702, may be standing tall with loose straight arms being elevated to shoulder height and eyes out onto the horizon with a tall spine. The soft round ball 703, of the kettlebell swing hat 702, may continue to arc towards the back of the head, giving instant feedback of a safe, powerful, and effective kettlebell swing.

Figure 8:
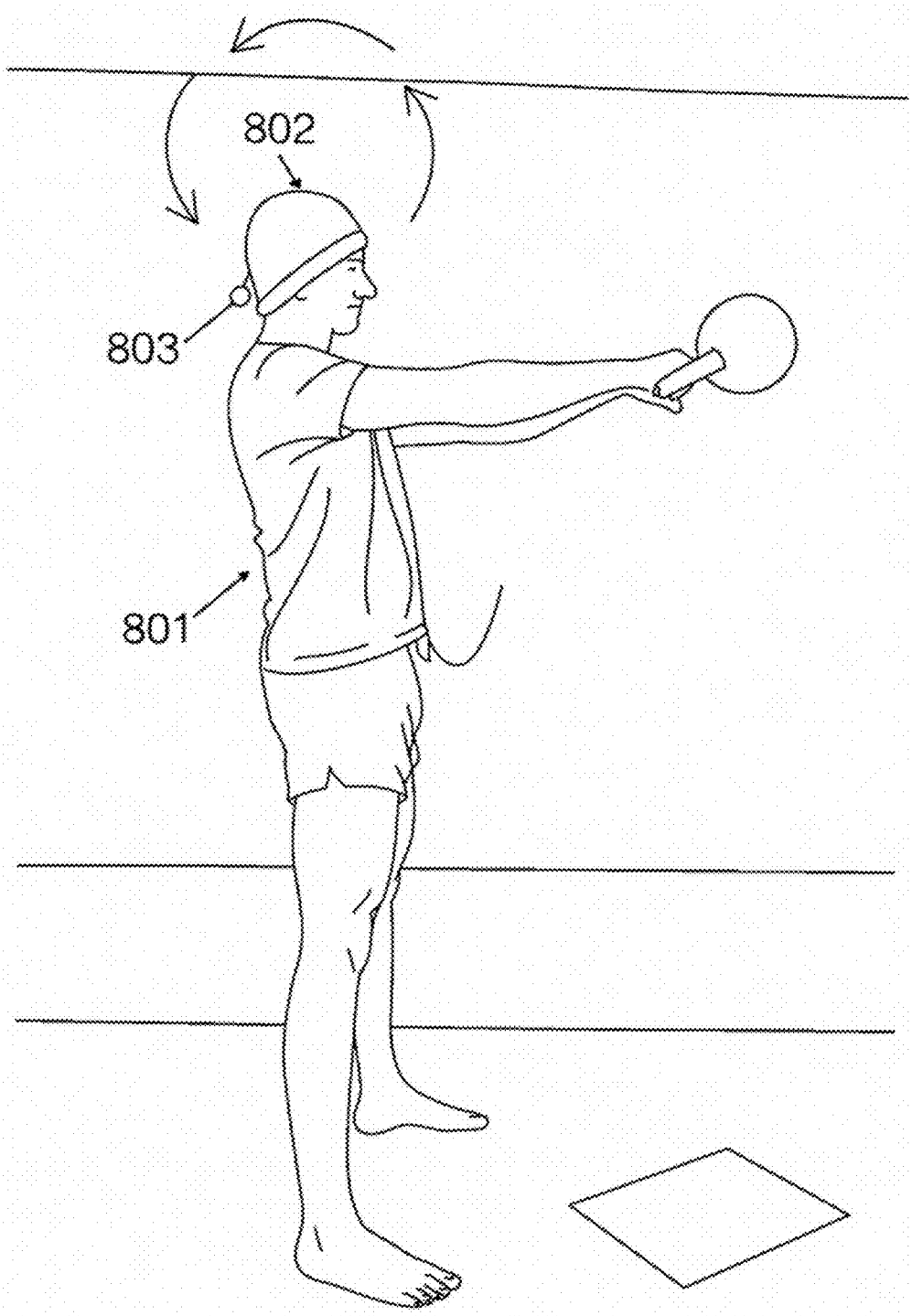
FIG. 8 is another example of a good kettlebell swing with the kettlebell at the top of the swing.

FIG. 8 is another example of a good kettlebell swing with the kettlebell at the top of the swing. As illustrated in FIG. 8, the user 801, wearing the kettlebell swing hat 802, the kettlebell 804 is at the top of the swing. At the top of the swing the user may be standing tall with loose straight arms at shoulder height and eyes out onto the horizon with a tall spine. The soft round ball 803, of the kettlebell swing hat 802, may have landed correctly at the back of the head, giving instant feedback of a safe, powerful, and effective kettlebell swing.

Figure 9:
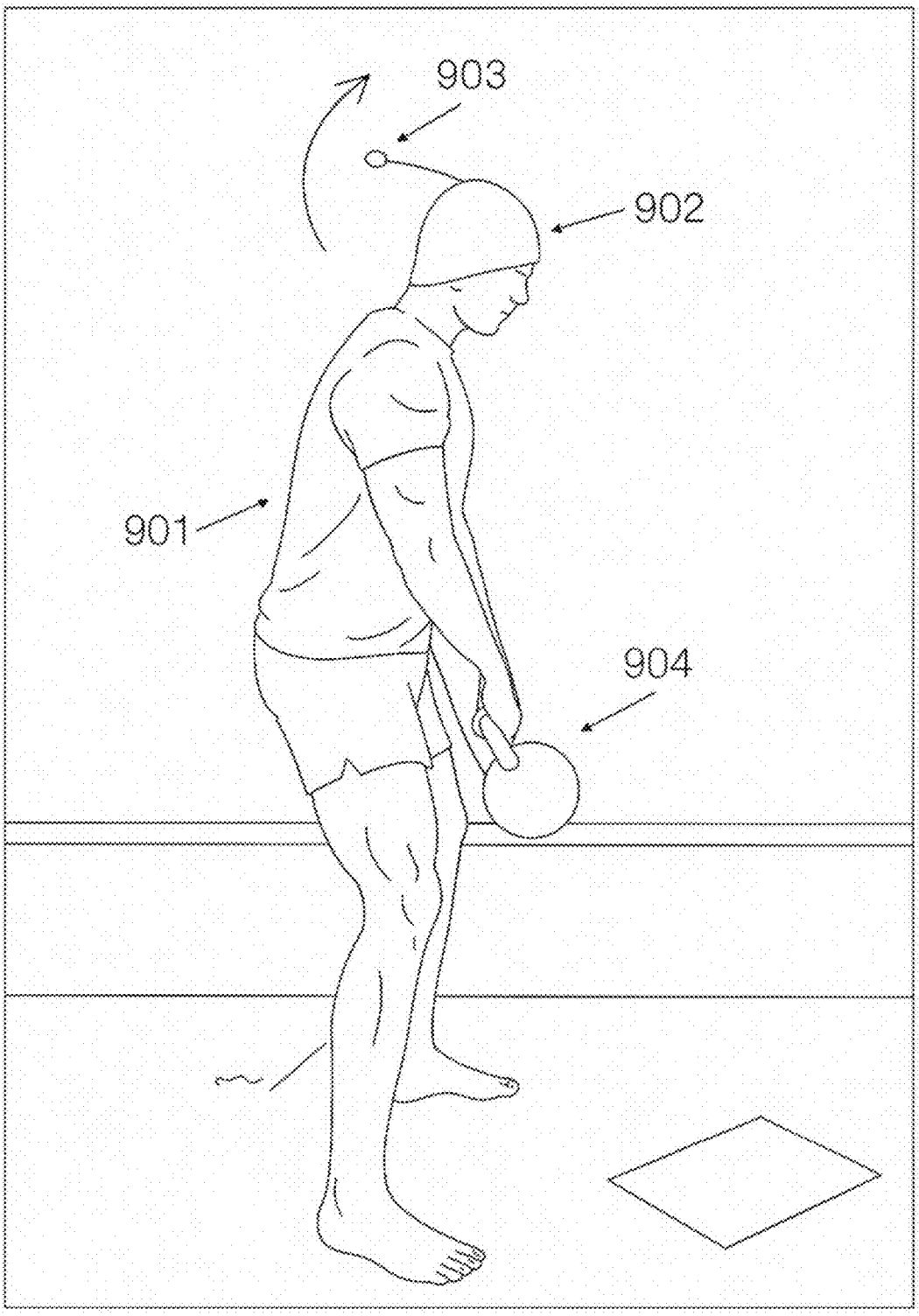
FIG. 9 is another example of a good kettlebell swing with the kettlebell in the descent.

FIG. 9 is another example of a good kettlebell swing with the kettlebell in the descent. As illustrated in FIG. 9, the user 901, wearing the kettlebell swing hat 902, the kettlebell 904 descending back down towards the bottom of the swing. The user 901 has successfully "waited patiently" until the forearms and biceps have come into contact with their rib cage before hinging their hips back. The trajectory of the soft round ball 903, of the kettlebell swing hat 902, may begin to arc back over the head down towards the center of the forehead at the bottom of the swing. The soft round ball 903 may flow back over the head indicating a safe, powerful and effective kettlebell swing.

Figure 10:
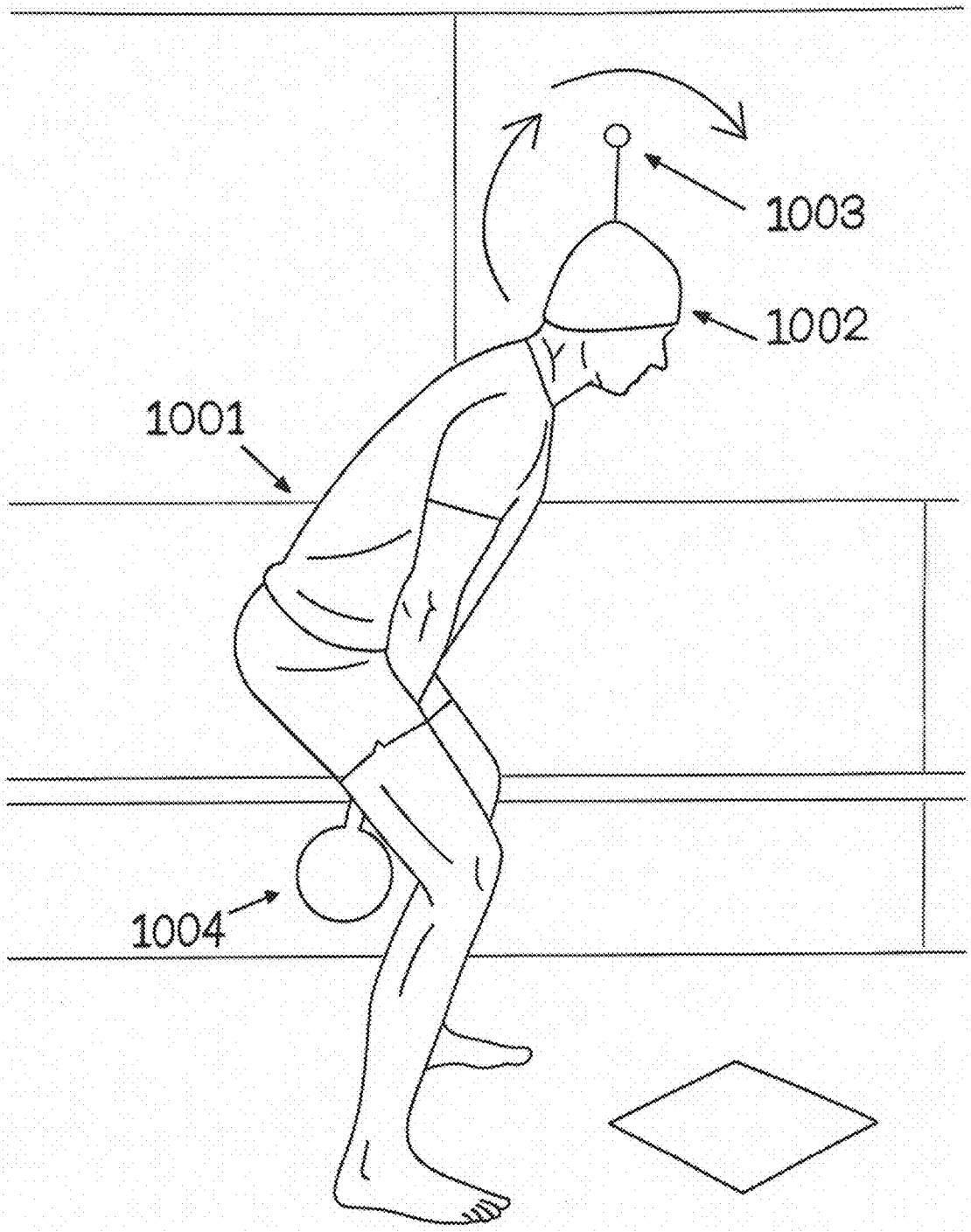
FIG. 10 is another example of a good kettlebell swing with the kettlebell in the descent.

FIG. 10 is another example of a good kettlebell swing with the kettlebell in the descent. As illustrated in FIG. 10, the user 1001, wearing the kettlebell swing hat 1002, the kettlebell 1004 descending back down towards the bottom of the swing. The user 1001 may continue lowering the kettlebell 1004 towards the bottom of the swing. The trajectory of the soft round ball 1003, of the kettlebell swing hat 1002, may continue to arc back over the head down towards the center of the forehead at the bottom of the swing. The soft round ball 1003 may flow back over the head indicating a safe, powerful and effective kettlebell swing.

Figure 11:
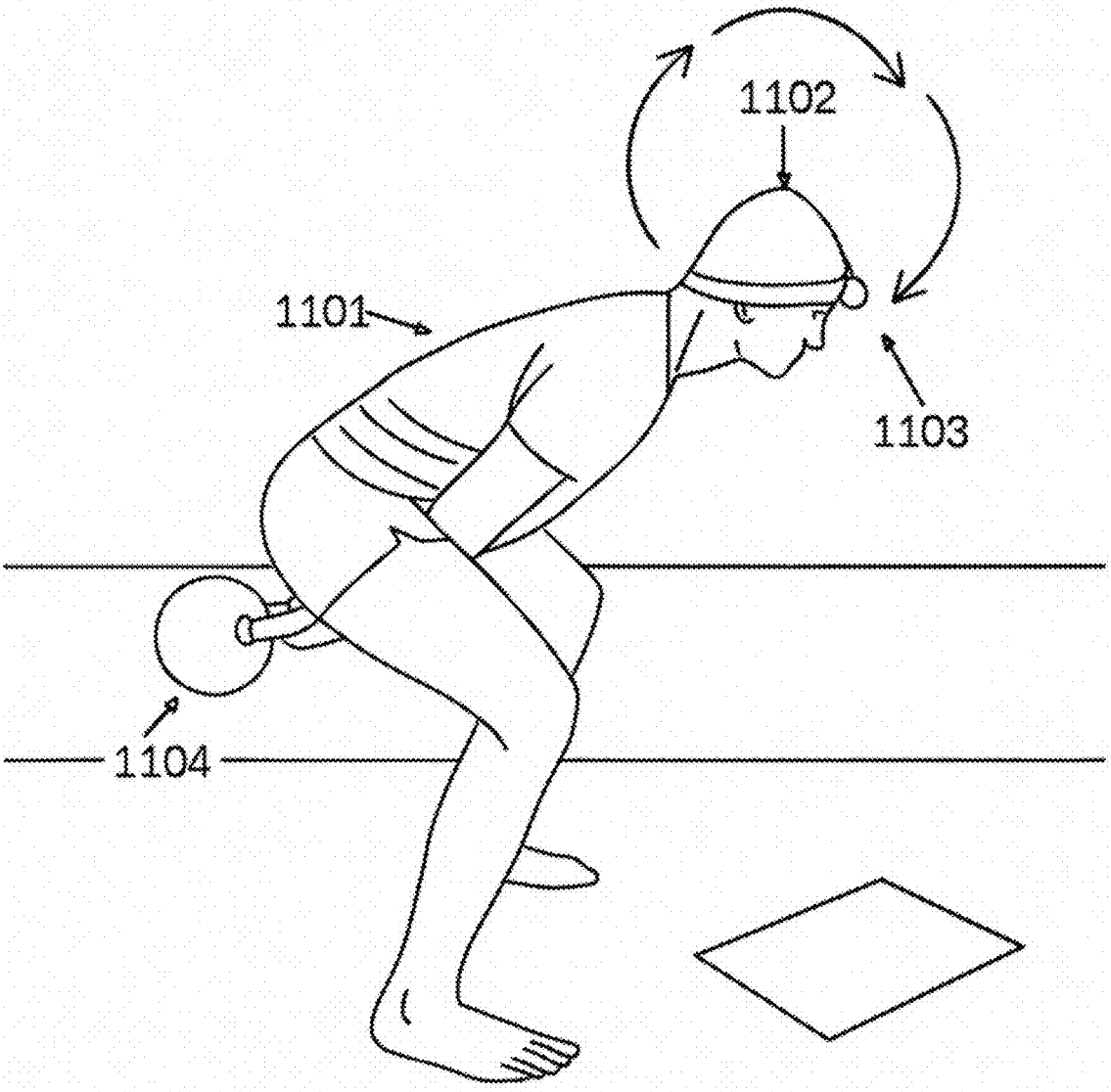
FIG. 11 is another example of a good kettlebell swing with the kettlebell at the bottom of the swing.

FIG. 11 is another example of a good kettlebell swing with the kettlebell at the bottom of the swing. As illustrated in FIG. 11, the user 1101, wearing the kettlebell swing hat 1102, may have the proper balance between hinging the hips back and squatting the hips down with eyes slightly up on the horizon with the kettlebell 1104 at the bottom of the swing. This bottom position of the swing is a good representation of what is needed in order to perform a safe, strong, powerful, and effective kettlebell swing. The soft round ball 1103 of the kettlebell swing hat 1102 may be tapping just above the forehead at the bottom of the swing. Seeing or feeling the soft round ball gently tap just above the forehead at the bottom of the kettlebell swing may provide instant feedback that the bottom part of the kettlebell swing is correct.

Examples of Bad Kettlebell Swings

In a first example of a bad kettlebell swing, the bottom portion of the swing may be too hinge. In this example, the user swinging the kettlebell is hinging their hips back too much and not "squatting" enough into the bottom of the swing. If the user was swinging the kettlebell correctly, then they would have their eyes slightly up onto the horizon with their knees under their hips, and their hips slightly under their shoulders. Creating a greater than symbol (>), allowing the soft round ball to come in contact with the correct target point just above the forehead. However, here the user swinging the kettlebell has their eyes straight down with hips too high which doesn't allow the soft round ball on the kettlebell swing hat to come into contact at the correct target point of the head at the bottom of the swing. This is a major indicator of an unsafe kettlebell swing. Instead the soft round ball is way too far out with the string fully extended and doesn't correctly showcase a safe, powerful, and effective swing.

In a second example of a bad kettlebell swing, the top portion of the swing may use too much of the user's arms. In this example, the user is utilizing too much of their arms during the ascent of the swing. In other words, the user is not using enough force from their legs, core, and butt to perform a correct swing, but instead is using their shoulders to lift the kettlebell up with slightly bent arms. As a result of this, the soft round ball stays behind the head during the duration of the swing and does not correctly showcase the proper form of the swing. Plus, by swinging incorrectly like this the soft round ball does not come in contact with the correct target point behind the head at the top of the swing to indicate good form of the swing. If one was swinging the kettlebell correctly then one would be in a tall standing plank position with extended arms straight out from the shoulders and the soft round ball would be coming in contact with the correct target point behind the head at the top of the swing. In order to have the soft round ball come into contact with the correct target point at the back of the head at the top of the swing one must drive their feet through the ground with force while standing tall with intention and allow the kettlebell to float up to shoulder height with loose arms.

FIGS. 12-15 illustrate a bad swing. For example, the bad swing may be too squatty or the swing may be too soft, weak, and inefficient. These examples illustrate major indicators of unsafe kettlebell swings.

Figure 12:
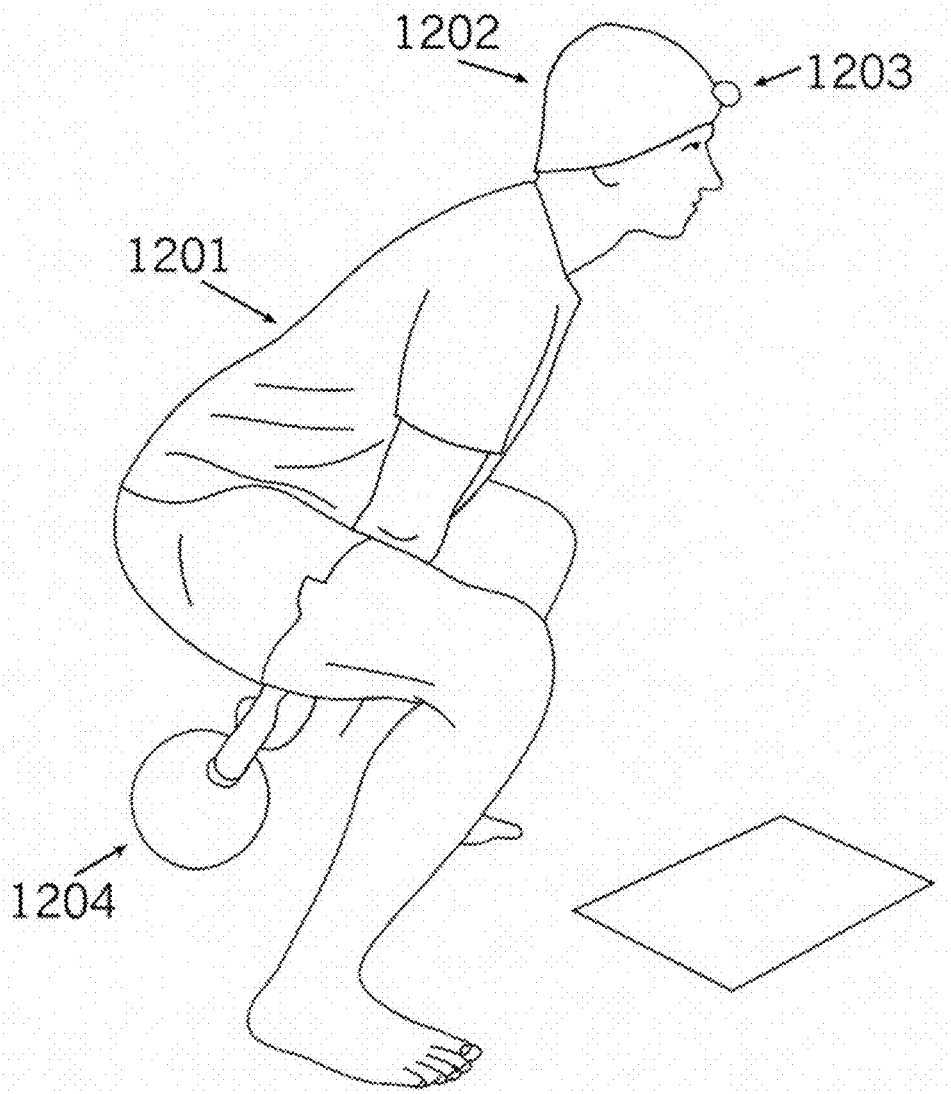
FIG. 12 is a first example of a bad swing with the kettlebell at the bottom of the swing.

FIG. 12 is a first example of a bad swing with the kettlebell at the bottom of the swing. As illustrated in FIG. 12, the user 1201, wearing the kettlebell swing hat 1202 and swinging the kettlebell 1204, may be squatting vertically too much and not hinging their hips back far enough. If the user 1201 was swinging the kettlebell 1204 correctly, then they would have their eyes slightly up onto the horizon with their knees under their hips, and their hips slightly under their shoulders; creating a greater than symbol (>), allowing the soft round ball 1203, of the kettlebell swing hat 1202, to come in contact with the correct target point just above the forehead. In contrast, the user 1201 has their head up too much and their hips too low. This position fails to allow the soft round ball 1203 to come into contact with the correct target point of the head at the bottom of the swing, for example, the center of the forehead. This is a major indicator of an unsafe kettlebell swing. Instead, as illustrated in FIG. 12, the soft round ball 1203 stays behind the head and doesn't correctly showcase a safe, powerful, and effective swing.

Figure 13:
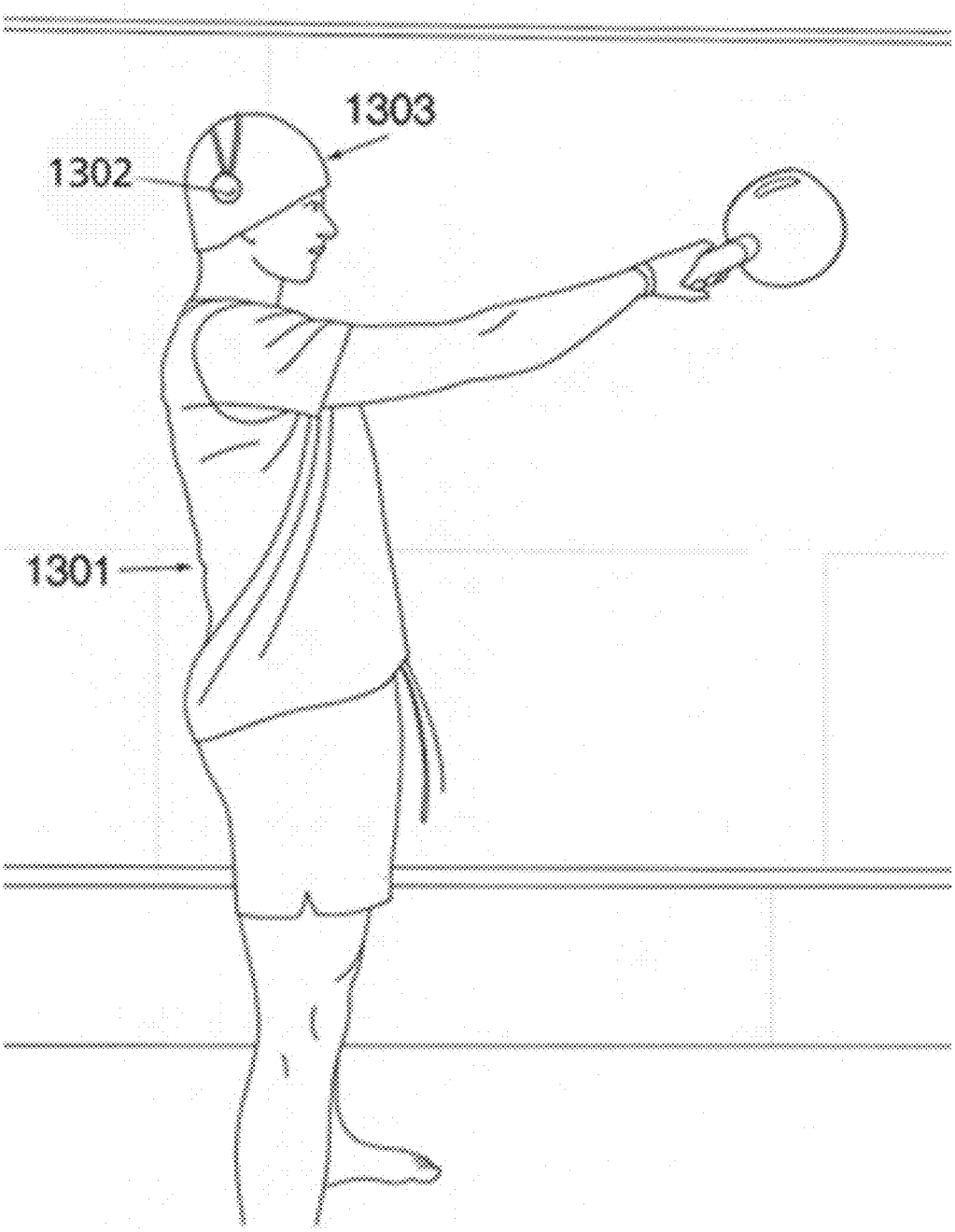
FIG. 13 is a first example of a bad swing with kettlebell at the top of the swing.

FIG. 13 is a first example of a bad swing with kettlebell at the top of the swing. At first glance, the swing depicted in FIG. 13 may look like a pretty good top part of the kettlebell swing. However, by looking at the location of the soft round ball 1303, of the kettlebell swing hat 1302 on the user 1301, one may notice that the soft round ball 1303 is dangling to the side of the person's head. This location of the soft round ball 1303 at the top of the swing may indicate that the user 1301 is performing a soft, weak, and inefficient swing. In other words, the user 1301 may not be using enough force from their legs, core, and butt to perform a powerful, strong, and effective swing. As a result of this soft and weak kettlebell swing, the soft round ball 1303 may just dangle and flail all over the place instead of coming in contact with the correct target point of the back of the head at the top of the swing. If the user 1301 was swinging the kettlebell correctly (as described herein) then the user 1301 would be in a tall standing plank position, however the soft round ball 1303 would be coming in contact with the correct target point behind the head at the top of the swing instead of just dangling off to the side of the head.

Figure 14:
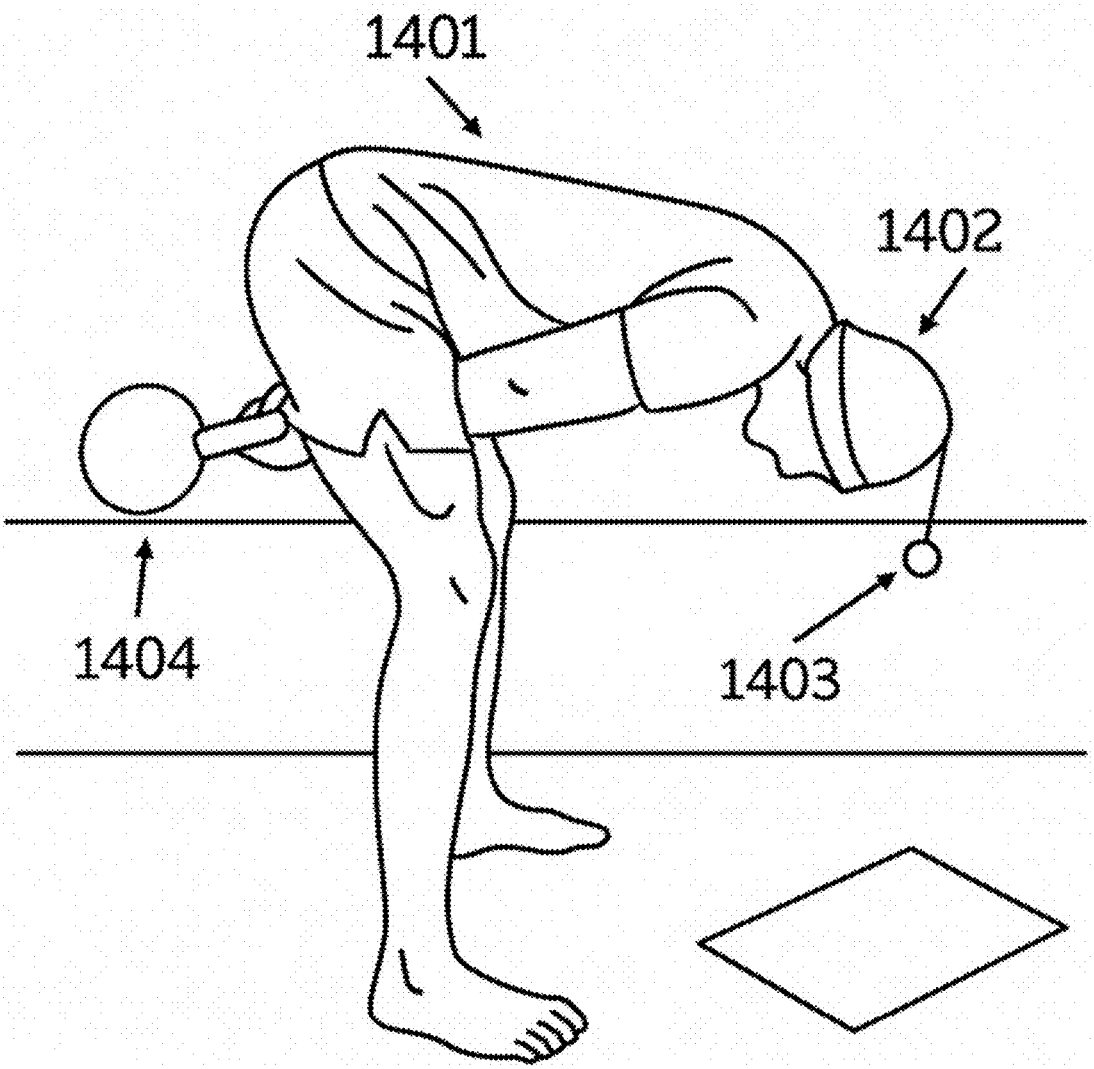
FIG. 14 is a second example of a bad swing with the kettlebell at the bottom of the swing.

FIG. 14 is a second example of a bad swing with the kettlebell at the bottom of the swing. As illustrated in FIG. 14, the user 1401, wearing the kettlebell swing hat 1402 and swinging the kettlebell 1404, may have their eyes straight down with their shoulders below their hips. This position may pace tremendous stress on the spine. If the user 1401 was swinging the kettlebell 1404 correctly, then they would have their eyes slightly up onto the horizon with their knees under their hips, and their hips slightly under their shoulders; creating a greater than symbol (>), allowing the soft round ball 1403, of the kettlebell swing hat 1402, to come in contact with the correct target point just above the forehead. In contrast, the user 1401 has their shoulders too low. This position fails to allow the soft round ball 1403 to come into contact with the correct target point of the head at the bottom of the swing, for example, the center of the forehead. This is a major indicator of an unsafe kettlebell swing. Instead, as illustrated in FIG. 14, the soft round ball 1403 hangs off the hat, failing to contact the forehead at all, and doesn't correctly showcase a safe, powerful, and effective swing.

Figure 15:
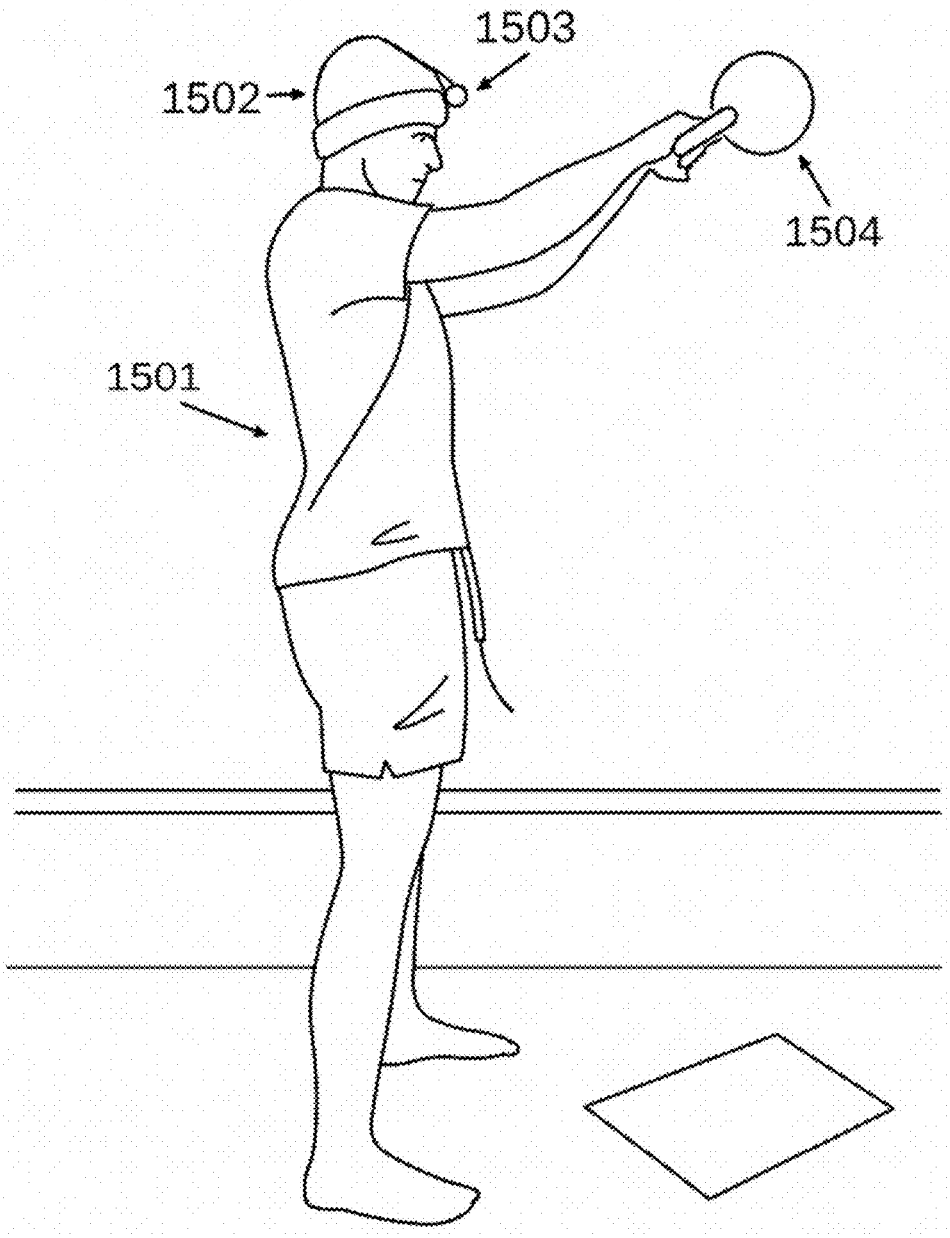
FIG. 15 is a second example of a bad swing with the kettlebell at the top of the swing.

FIG. 15 is a second example of a bad swing with the kettlebell at the top of the swing. As illustrated in FIG. 15, the user 1501, wearing the kettlebell swing hat 1502 and swinging the kettlebell 1504, may have bent arms and their shoulders are shrugging upwards. This position indicates that the user 1501 may be using their arms to lift the bell. The location of the soft round ball 1503, at the front of the forehead while at the top of the swing, may indicate that the user 1501 is using too much of their arms in the swing. In other words, the user 1501 may not be using enough force from their legs, core, and butt to perform a powerful, strong, and effective swing. If the user 1501 was swinging the kettlebell correctly (as described herein) then the user 1501 would be in a tall standing plank position, however the soft round ball 1503 would be coming in contact with the correct target, for example, the back of the head.

Those of ordinary skill in the art may recognize that many modifications and variations of the above may be implemented without departing from the spirit or scope of the following claims. Thus, it is intended that the following claims cover the modifications and variations provided they come within the scope of the appended claims and their equivalents.

What is claimed:

1. A kettlebell swing hat comprising:

a beanie cap with two holes at the crown of the beanie cap;

a round ball wherein the round ball has two holes therethrough; and a string with a first end and a second end;

wherein the string secures the round ball to the beanie cap by knotting the first end and the second end together.

2. The kettlebell swing hat of claim 1, wherein the first end of the string goes through the round ball so that the round ball is in the middle of the string; and wherein the first end of the string goes through one of the two holes of the beanie cap and the second end of the string goes through the other one of the two holes of the beanie cap.

3. The kettlebell swing hat of claim 1, wherein the string is 12-24 inches in length.

4. The kettlebell swing hat of claim 1, wherein the string is at least one of nylon, synthetic fibers, such as nylon, textured polyester, spun polyester, or polypropylene.

5. The kettlebell swing hat of claim 1, wherein the round ball is at least one of cotton, sponge, or orlon fiber.

6. The kettlebell swing hat of claim 1, wherein the each of the two holes of the beanie cap are 2 mm wide.

7. The kettlebell swing hat of claim 1, wherein the two holes of the beanie cap are 1 cm apart.

8. The kettlebell swing hat of claim 1, wherein a thickness of the string secures the round ball in place.

9. A method for providing instant feedback of a kettlebell swing using a kettlebell swing hat, the method comprising:

placing the kettlebell swing hat on a user's head, wherein the kettlebell swing hat comprises a beanie cap with a round ball secured to the beanie cap with a string;

bending down into a hinge position to lift the kettlebell;

ascending the kettlebell to a top of the kettlebell swing;

descending the kettlebell to the bottom of the kettlebell swing; and on a condition that the kettlebell swing is performed correctly, the round ball of the kettlebell swing hat hitting a user's forehead at the bottom of the kettlebell swing and the round bell hitting a back of the user's head at the top of the kettlebell swing.

10. The method of claim 9, wherein the beanie cap has two holes at the crown of the beanie cap and the round ball with the two holes through the round ball; and the string has a first end and a second end.

11. The method of claim 10, wherein the string secures the round ball to the beanie cap by knotting the first end and the second end together.

12. The method of claim 10, wherein the first end of the string goes through the round ball so that the round ball is in the middle of the string; and wherein the first end of the string goes through one of the two holes of the beanie cap and the second end of the string goes through the other one of the two holes of the beanie cap.

13. The method of claim 9, wherein the string is 12-24 inches in length.

14. The method of claim 9, wherein the string is at least one of nylon, synthetic fibers, such as nylon, textured polyester, spun polyester, or polypropylene.

15. The method of claim 9, wherein the round ball is at least one of cotton, sponge, or orlon fiber.

16. The method of claim 10, wherein the each of the two holes of the beanie cap are 2 mm wide.

17. The method of claim 10, wherein the two holes of the beanie cap are 1 cm apart.

18. The method of claim 9, wherein a thickness of the string secures the round ball in place.

* * * * *